US009679537B2

(12) United States Patent
Nakaya

(10) Patent No.: US 9,679,537 B2
(45) Date of Patent: Jun. 13, 2017

(54) BIT EXPANSION METHOD AND APPARATUS

(71) Applicant: LG DISPLAY CO., LTD., Seoul (KR)

(72) Inventor: Hideo Nakaya, Tokyo (JP)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/876,383

(22) Filed: Oct. 6, 2015

(65) Prior Publication Data

US 2016/0104459 A1 Apr. 14, 2016

(30) Foreign Application Priority Data

Oct. 8, 2014 (JP) ..... 2014-206985

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/0276* (2013.01); *G09G 2340/0428* (2013.01)

(58) Field of Classification Search
None
See application file for complete search history.

(56) References Cited

U.S. PATENT DOCUMENTS

2008/0056607 A1* 3/2008 Ovsiannikov ..... H04N 5/217 382/275
2012/0281008 A1* 11/2012 Marcu ..... G09G 3/006 345/589
2013/0016189 A1* 1/2013 Hosaka ..... H04N 13/0239 348/49
2013/0162625 A1* 6/2013 Schmit ..... G06T 3/40 345/419
2013/0201371 A1* 8/2013 Ogasahara ..... H04N 5/21 348/294
2015/0206024 A1* 7/2015 Sasaki ..... G06T 5/002 382/190

FOREIGN PATENT DOCUMENTS

JP 2008-301010 A 12/2008
KR 10-0679047 B1 2/2007

* cited by examiner

*Primary Examiner* — James A Thompson
(74) *Attorney, Agent, or Firm* — Dentons US LLP

(57) ABSTRACT

Disclosed is a bit expansion process portion that expands p bits, which a resolution of a brightness value of a digital input picture has, to q bits (where q>p). When a brightness value of an attention pixel of the digital input picture is bit-expanded, the bit expansion process portion applies a weight to the brightness value of the attention pixel according to a magnitude relation of the brightness value of the attention pixel and brightness values of a plurality of surrounding pixels, which are located surrounding the attention pixel, and conducts a gain compensation for the brightness value of the attention pixel after the weight is applied, thereby performing a bit expansion process from the p bits to the q bits.

5 Claims, 6 Drawing Sheets gamma(=2.2) conversion curve input picture histogram histogram after gamma conversion

BIT EXPANSION METHOD AND APPARATUS

The present application claims the priority benefit of Japanese Patent Application No. 2014-206985 filed in Japan on Oct. 8, 2014, which is hereby incorporated by reference in its entirety for all purposes as if fully set forth herein.

BACKGROUND OF THE INVENTION

Field of the Invention

The present invention relates to a bit expansion method and apparatus that do not cause a picture deterioration when displaying with expanding a number of bits.

Discussion of the Related Art

In picture displays such as a TV and a PC, R, G and B data each mostly have a 8-bit precision. When a certain picture signal processing is conducted for an input image (R, G and B data of which each have 8 bits) and then the image is displayed, a reliable bit length becomes less than a 8-bit length due to accumulation of operation error, and thus there occurs a false contour.

A noticeable example of a picture signal process is a gamma correction process. However, in the gamma correction process, there is reduction of a bit precision when converting input 8 bits with a LUT (look-up table) or the like.

To solve the problem, there is a method that an 8 bit input is expanded to a 10 bit then is inputted to a LUT. FIG. 8 is a block diagram of a picture signal process apparatus according to the related art. Concretely, it is shown that an input picture of 8 bits is expanded to a picture of 10 bits, then a gamma correction process is conducted, and then the processed picture is outputted to a display panel. By conducting a bit expansion process and then conducting a desired operation process such as a gamma correction or the like, suppressing a deterioration of a bit precision is considered.

However, the related art has problems in operation precision and grey level conversion as follows.

(1) As to a Problem in Operation Precision:

A multiplication is a main operation in a filter or the like. For the sake of brevity, in a fixed-length operation, a multiplication of an 8 bit input by an 8 bit coefficient is assumed. FIG. 9 is a view explaining a state that a deterioration of precision occurs by conducting a multiplication in the related art picture process apparatus. Even though a bit precision is maintained in intermediate operation, when a rounding process of 8 bits is finally conducted, a significant bit number becomes 7 bits.

Further, in case of using 2-stage filter, a significant bit number is further reduced by 1 bit and becomes 6 bits. As operation is repeated, a significant number is reduced, and thus a picture has a 6 bit or 5 bit precision. Accordingly, there occurs a problem that a false contour is seen at a gradation portion.

(2) As to a Problem in Grey Level Conversion:

For example, regarding a gamma correction, in a gamma correction of 8 bit input and 8 bit output, there is a case that an existence range of pixel value is discontinuous. FIG. 10 is a view explaining change of histogram when conducting a grey level conversion in the related art picture signal process apparatus. FIG. 10A shows a conversion curve when obtaining 8 bit output data by conducting a gamma correction for 8 bit input data. FIG. 10B shows a histogram of an input picture, and FIG. 10C shows a histogram of a picture after a gamma correction. As is plain based on comparison of FIG. 10B with FIG. 10C, a discontinuous change in frequency distribution of pixel value after a gamma correction happens, and thus there is a case that smoothness of an original picture is lost.

The summary of the above matters is as follows. For example, there is a case that a brightness adjustment and color tone adjustment, or grey level conversion or filter process for display quality improvement is conducted for an 8 bit input picture. However, in such the operation, a rounding error of operation is accumulated due to limitation of hardware, and thus there is a case that a reliable bit precision is less than 6 bits or 5 bits. As a result, it is problematic that a display quality deterioration such as a false contour or the like is seen at a gradation portion.

Further, this problem is not improved by simply bit-expanding an input picture, and, to prevent a picture deterioration, it has been required that a bit expansion process is conducted appropriately according to a brightness distribution state of an input picture.

SUMMARY OF THE INVENTION

Accordingly, the present invention is directed to an OLED that substantially obviates one or more of the problems due to limitations and disadvantages of the related art.

An object of the present invention is to provide a picture signal process apparatus and a bit expansion method that can expand grey level at high precision from p bits to q bits according to a brightness distribution state of an input image such that a display quality deterioration such as a false contour or the like is prevented without reduction of precision by accumulation of operation error.

Additional features and advantages of the disclosure will be set forth in the description which follows, and in part will be apparent from the description, or may be learned by practice of the disclosure. The advantages of the disclosure will be realized and attained by the structure particularly pointed out in the written description and claims as well as the appended drawings.

To achieve these and other advantages, and in accordance with the purpose of the present invention, as embodied and broadly described herein, a picture signal process apparatus includes a bit expansion process portion that expands p bits, which a resolution of a brightness value of a digital input picture has, to q bits (where q>p), wherein when a brightness value of an attention pixel of the digital input picture is bit-expanded, the bit expansion process portion applies a weight to the brightness value of the attention pixel according to a magnitude relation of the brightness value of the attention pixel and brightness values of a plurality of surrounding pixels, which are located surrounding the attention pixel, and conducts a gain compensation for the brightness value of the attention pixel after the weight is applied, thereby performing a bit expansion process from the p bits to the q bits.

In another aspect, a bit expansion method which is performed at a picture signal process apparatus including a bit expansion process portion that expands p bits, which a resolution of a brightness value of a digital input picture has, to q bits (where q>p) includes a weight application step at the bit expansion process portion of, when a brightness value of an attention pixel of the digital input picture is bit-expanded, applying a weight to the brightness value of the attention pixel according to a magnitude relation of the brightness value of the attention pixel and brightness values of a plurality of surrounding pixels, which are located surrounding the attention pixel; and a gain compensation step at the bit expansion process portion of conducting a gain compensation for the brightness value of the attention pixel after the weight is applied, thereby performing a bit expansion process from the p bits to the q bits.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION OF THE ILLUSTRATED EMBODIMENTS

Reference will now be made in detail to embodiments, examples of which are illustrated in the accompanying drawings. The same or like reference numbers may be used throughout the drawings to refer to the same or like parts.

The present invention is characterized in embodying a picture signal process apparatus and a bit expansion method that save a local feature of a picture and expand grey level to q bits (e.g., 10 bits or 12 bits) of high precision in advance according to a brightness distribution state of an input picture, thus maintain a bit precision, which is reliable after operation for an input picture after bit expansion, with 8 bits or more, and does not cause a display quality deterioration. Reference will now be made in detail to embodiments, examples of which are illustrated in the accompanying drawings.

First Embodiment

Figure 1:
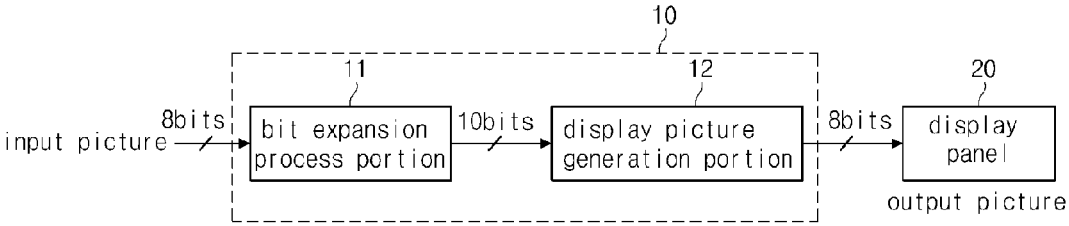
FIG. 1 is a block diagram of a picture signal process apparatus according to a first embodiment of the present invention.

FIG. 1 is a block diagram of a picture signal process apparatus according to a first embodiment of the present invention. The picture signal process apparatus 10 of the first embodiment includes a bit expansion process portion 11 and a picture generation process portion 12, and an output picture after process by a display picture generation process portion 12 is displayed at a display panel 20. Further, in FIG. 1, a case that an input picture has 8 bits, a picture after bit expansion process has 10 bits, and an output picture has 8 bits is shown as an example.

However, the present invention is not limited to expansion from 8 bits to 10 bits as shown in FIG. 1. The point of the present invention is that, by saving a local feature of a picture and expanding p bits of an input picture to q bits (q>p) according to a brightness distribution state of an input picture, deterioration of display quality after process by the display picture process portion 12 is prevented.

Figure 2:
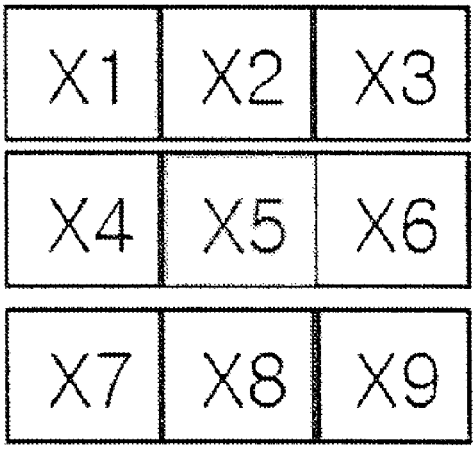
FIG. 2 is a view explaining a bit expansion algorithm by a bit expansion process portion of a first embodiment of the present invention.

With generalization for a case of expanding p bits of an input picture to q bits, a key part of bit expansion algorithm of the first embodiment is explained. FIG. 2 is a view explaining a bit expansion algorithm by a bit expansion process portion of a first embodiment of the present invention.

The bit expansion process portion 11 conducts a comparison operation as below to detect a local feature for change of 8 pixels X1 to X4 and X6 to X9 around an attention pixel X5.

```
sum = 0;
for( i= 1; i <=9; i++) {
   if ( Xi > X5 ) sum += 1;
   if ( Xi < X5 ) sum -= 1;
}
wgt = sum / 16;
wgt *= ma;
if ( wgt > 0.5 )  wgt = 0.5;
if ( wgt < -0.5 ) wgt = -0.5;
```

$$\text{output} = (X5 + \text{wgt} + 0.5) * \frac{2^q - 1}{2^p};$$

```
if (output > (2^q - 1)) output = 2^q -1;
if (output < 0)         output = 0
```

When the result of the comparison operation is that all of the surrounding pixels X1 to X4 and X6 to X9 are less than the attention pixel X5, sum=−8. On the other hand, when the result of the comparison operation is that all of the surrounding pixels X1 to X4 and X6 to X9 are greater than the attention pixel X5, sum=+8. Accordingly, the sum has a value in a range of −8 to +8 according to large or small relation of the attention pixel X5 and the surrounding pixels X1 to X4 and X6 to X9.

Further, a weight is applied to the sum calculated as an index value indicating such the change, an offset of 0.5 is combined with the weight-applied value, and the combined value is added to the original pixel value X5, and thus a bin expansion is conducted.

In the bit expansion process, an coefficient for normalization to be within an existence range of an originally-quantized pixel value is 1/16, and the wgt is limited in a range of −0.5 to +0.5.

Further, the ma is a coefficient to adjust an effect extent of bit expansion, usually a value of 0.0 to 0.1. When the ma is set over 1.0, a final weight is needed to be cut in a range of −0.5 to +0.5.

Further, a coefficient to compensate for a total gain is $(2^q-1)/2^p$.

By conducting the above operation process for each attention pixel, a bit expansion process of an attention pixel is conducted reflecting an effect of surrounding pixels which is a local feature of a picture.

Further, in FIG. 2, surrounding 8 pixels are defined as the pixels X1 to X4 and X6 to X9 adjacent to the attention pixel X1. However, for a picture where the pixels X1 to X4 and X6 to X9 adjacent to the attention pixel X5 are hardly changed, a case that an effect of the pixels X1 to X4 and X6 to X9 adjacent to the attention pixel X5 is not reflected sufficiently is thought.

Figure 3:
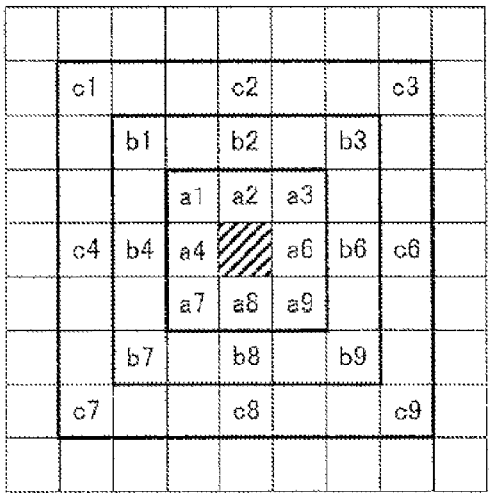
FIG. 3 is a view of an example of 3 kinds of surrounding pixel pattern to be selected at the bit expansion process portion of a first embodiment of the present invention.

In the present invention, it is possible that 8 pixels, which are farther from the attention pixel X5 than X1 to X4 and X6 to X9 are, are selected. This case is explained with reference to FIG. 3. FIG. 3 is a view of an example of 3 kinds of surrounding pixel pattern to be selected at the bit expansion process portion of a first embodiment of the present invention.

In FIG. 3, as selectable surrounding pixel pattern, 3 patterns are shown. Further, in FIG. 3, a pixel hatched slantly is an attention pixel.

A pattern A is defined with 8 pixels a1 to a4 and a6 to a9 adjacent to the attention pixel as surrounding pixels.

A pattern B is defined with 8 pixels b1 to b4 and b6 to b9, which are away by 1-pixel distance from the attention pixel, as surrounding pixels.

A pattern C is defined with 8 pixels c1 to c4 and c6 to c9, which are away by 2-pixel distance from the attention pixel, as surrounding pixels.

The selections of the pattern A and the pattern B are explained in detail as examples. The bit expansion process portion 11 calculates a variation value for brightness values of 9 pixels in a 3*3 region with an attention pixel as a center. When the calculated variation value is greater than a pre-set threshold value for decision, the bit expansion process portion 11 decides that since 8 pixels a1 to a4 and a6 to a9 are randomly distributed with respect to the attention pixel a5, conducting a bit expansion process reflecting an effect thereof is proper, and selects pixels of the pattern A as surrounding pixels.

However, when the calculated variation value is a pre-set threshold value for decision or less, the bit expansion process portion 11 decides that since 8 pixels a1 to a4 and a6 to a9 are not randomly distributed with respect to the attention pixel a5, conducting a bit expansion process reflecting an effect thereof is not proper, and selects pixels of the pattern B, which is farther than the pattern A, as surrounding pixels.

Further, it is possible that selecting the pattern C instead of the pattern B as a farther pattern is set in advance.

Figure 4:
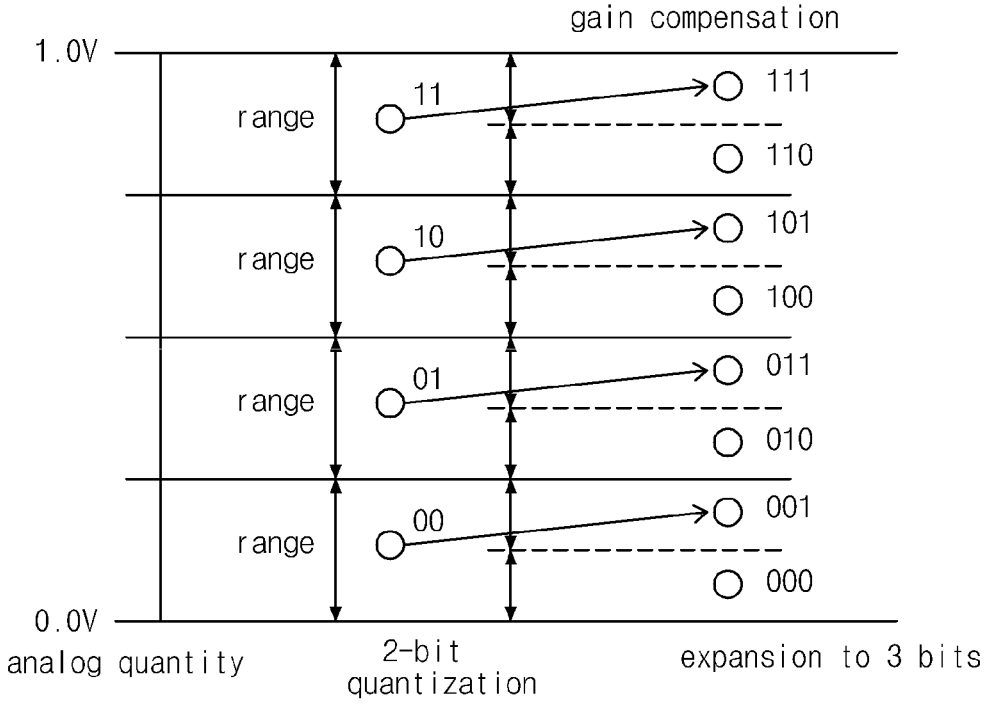
FIG. 4 is a view explaining a existence range (range) of pixel value and a consideration method of gain compensation in a uniform quantization of a first embodiment of the present invention.

Further, in the same manner as above, it is possible that the bit expansion process portion 11 decides which one of the pattern B and the pattern C is selected as a surrounding pixel pattern based on a variation value of a 5*5 region with the attention pixel as a center Principle and effectiveness of the bit expansion process of the first embodiment are explained with reference to FIGS. 4 and 5. FIG. 4 is a view explaining a existence range (range) of pixel value and a consideration method of gain compensation in a uniform quantization of a first embodiment of the present invention. For the sake of brevity, in FIG. 4, bit expansion from 2 bits to 4 bits is shown as an example.

As shown in FIG. 4, 2 bit data having 4 ranges of 00 to 11 is bit-expanded by conducting a gain compensation and thus it is expanded to 3 bit data having 8 ranges of 000 to 111. In this case, for example, when a range 01 of 2 bits is bit-expanded, whether a range of 3 bits is 011 or 010 becomes a problem. Merely bit-expanding to one of two ranges would make data after bit expansion biased.

In this regard, according to the present invention, in a bit expansion, a gain compensation to a specific bit depending on only an attention pixel value is not conducted, and rather, considering a logical feature of brightness values at surrounding pixels, for example, whether a range 01 of 2 bits is expanded to 011 or 010 is decided. As a result, data after bit expansion exist all over the ranges based on a logical feature.

Figure 5:
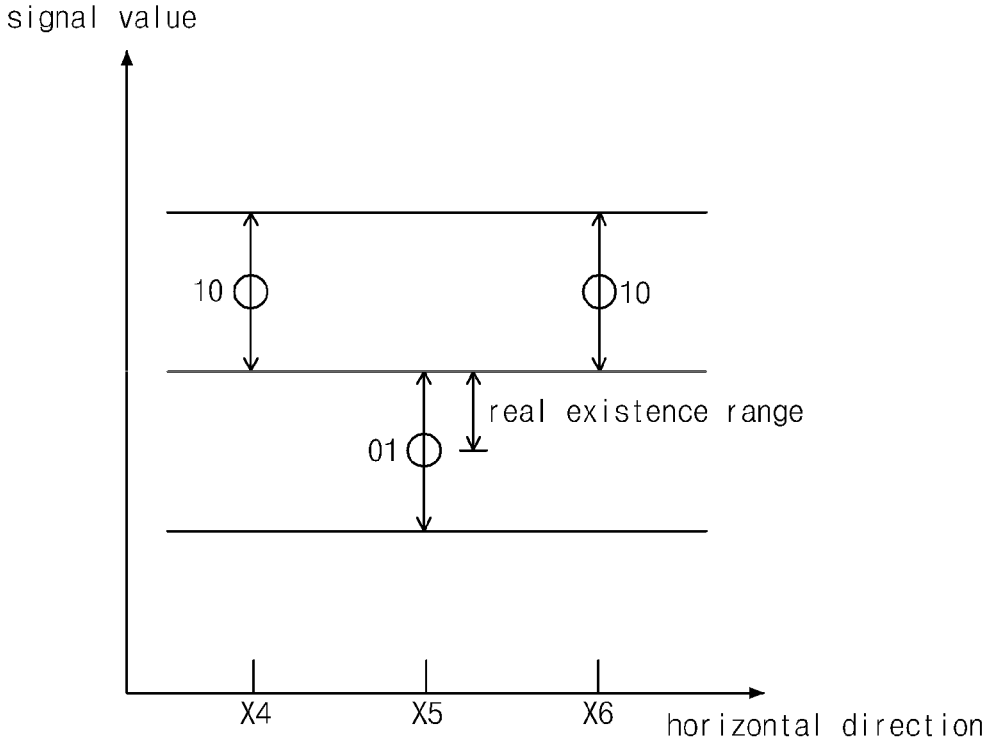
FIG. 5 is a view explaining an effect using a logical feature of a picture of a first embodiment of the present invention.

FIG. 5 is a view explaining an effect using a logical feature of a picture of a first embodiment of the present invention. For the sake of brevity, in FIG. 5, with 2 bit data as an example, an effect by considering a logical feature of surrounding pixels X4 and X6 in a horizontal direction for an attention pixel X5 is shown.

The example of FIG. 5 shows a state that, in a 2 bit data picture, a brightness value (a signal value) of the attention pixel X5 is 01, and brightness values of the surrounding pixels X4 and X6 are all 10. According to the present invention, in this state, by considering a logical feature of the surrounding pixels, the attention pixel X5 is supposed as a data of a 'real existence range' close to a range 10, as shown in FIG. 5, and becomes a range 011 when being expanded to 3 bits.

Further, in FIG. 5, an upper half location out of a range 10 is specified as a 'real existence range', but there is a case of specifying an lower half location as a 'real existence range' according to a logical feature. In the present invention, by conducting the comparison operation process shown in the above formula for each attention pixel then applying a weight considering a logical feature and then conducting a bit expansion, a 'real existence range' is specified, as shown in FIG. 5, and then a proper bit expansion process is realized.

Figure 6:
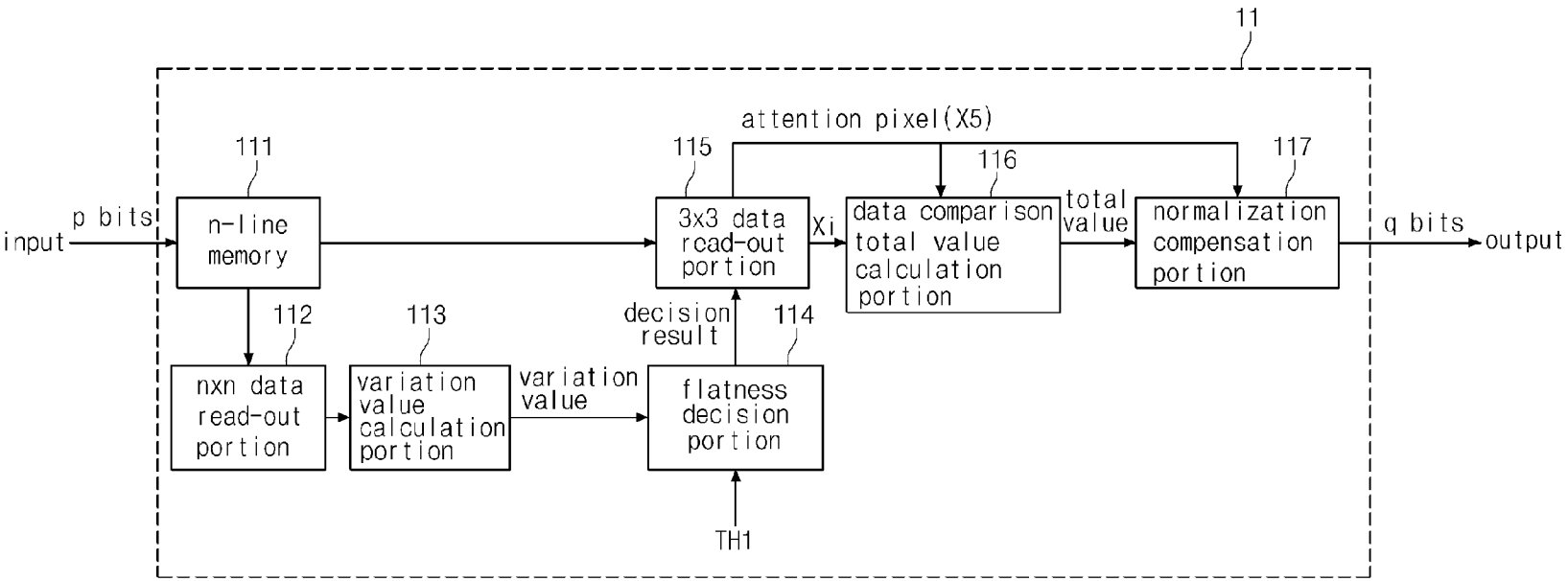
FIG. 6 is a view of a detailed configuration of a bit expansion process portion of a first embodiment of the present invention.
Figure 7:
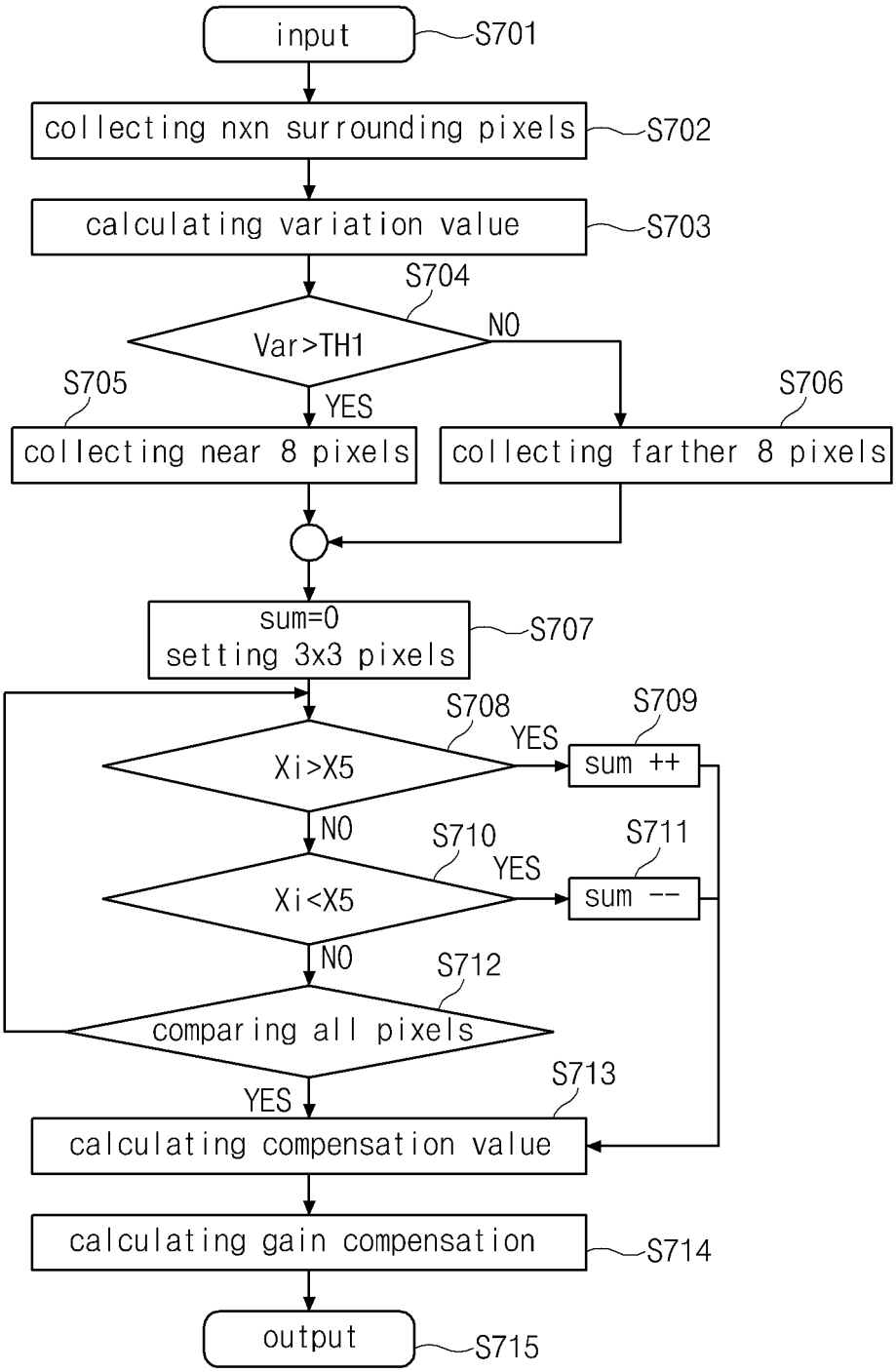
FIG. 7 is a flow chart of a series of processes by the bit expansion process portion and the display picture generation portion of a first embodiment of the present invention.
Figure 8:
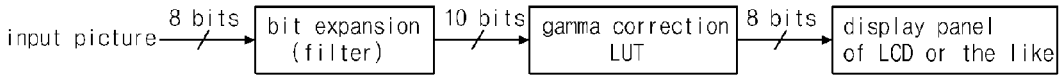
FIG. 8 RELATED ART
FIG. 8 is a block diagram of a picture signal process apparatus according to the related art.
Figure 9:
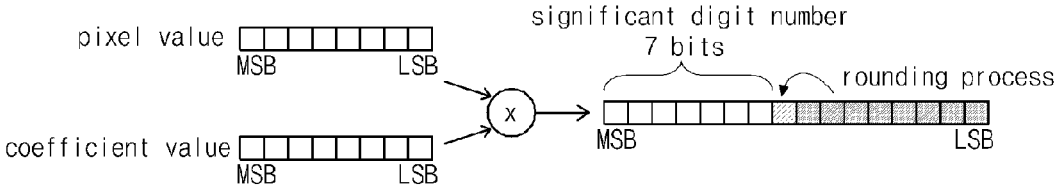
FIG. 9 RELATED ART
FIG. 9 is a view explaining a state that a deterioration of precision occurs by conducting a multiplication in the related art picture process apparatus.
Figure 10A:
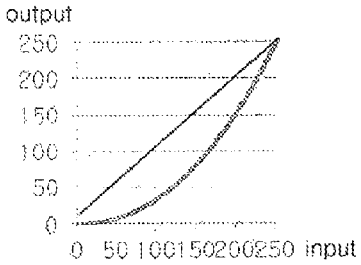
FIGS. 10A, 10B and 10C are views explaining a change of histogram when conducting a grey level conversion in the related art picture signal process apparatus.
Figure 10B:
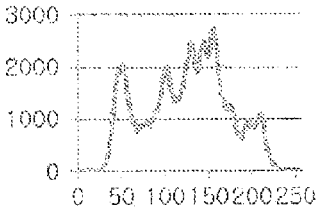
Figure 10C:
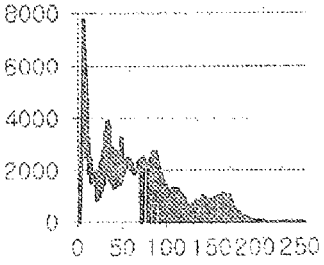

A detailed configuration and a detailed process of the bit expansion process portion 11 are explained with reference to drawings. FIG. 6 is a view of a detailed configuration of a bit expansion process portion of a first embodiment of the present invention. FIG. 7 is a flow chart of a series of processes by the bit expansion process portion and the display picture generation portion of a first embodiment of the present invention. The series of processes shown in the flow chart of FIG. 7 is explained based on the operation process shown in the above formula and the internal configuration of FIG. 6.

In the below explanations, explained is a case that n=5, and surrounding pixels, which become objects of a logical feature to consider when conducting bit expansion of an attention pixel, switch between the pattern A (i.e., the surrounding pixels a1 to a4 and a6 to a9) and the pattern B (the surrounding pixels b1 to b4 and b6 to b9) shown in FIG. 3.

A p bit data input is first stored in a n-line memory (111) (step S701). Then, a n*n data read-out portion 112 reads out n*n block data from the n-line memory 111 (step S702). In other words, when n=5, a 5*5 region including the pattern A and the pattern B is extracted.

Then, a variation value calculation portion 113 calculates a variation value for a 3*3 region (step S703). A flatness decision portion 114 compares the variation value calculated from the variation value calculation portion 113 with a pre-set threshold value TH1, and outputs a decision result of 0 when the variation value is less than the threshold value TH1 (which means a decision that a flatness is high and the region is a flat portion based on the variation value being small), and outputs a decision result of 1 when the variation value is equal to or greater than the threshold value TH1

(which means a decision that a flatness is low and the region is not a flat portion based on the variation value being great) (step S704).

Then, the 3*3 data read-out portion 115 reads out nearest 3*3 data from the n-line memory 111 when the decision result of the flatness decision portion 114 is 1 (step S705). In other words, 3*3 data, which consist of an attention pixel and surrounding pixels a1 to a4 and a6 to a9 defined as the pattern A for the attention pixel, are read out.

However, the 3*3 data read-out portion 115 reads out farther 3*3 data from the n-line memory 111 when the decision result of the flatness decision portion 114 is 0 (step S706). In other words, 3*3 data, which consist of an attention pixel and surrounding pixels a1 to a4 and a6 to a9 defined as the pattern B for the attention pixel, are read out.

As such, according to the decision results of the flatness decision portion 114, when surrounding pixels are not flat, the 3*3 data read-out portion 115 collects 8 pixels close to an attention pixel as surrounding pixels, and when surrounding pixels are flat, the 3*3 data read-out portion 115 collects 8 pixels far from an attention pixel as surrounding pixels. Accordingly, according to a brightness distribution state of an input picture, 3*3 data suitable to conduct a bit expansion process can be read out.

Then, a data comparison total value calculation portion 116 initializes a total value sum to 0, and sets the 3*3 data read out at the step S705 or S706 as X1 to X9 shown in FIG. 2 (step S707).

Then, the data comparison total value calculation portion 116 considers a center portion X5 among the 3*3 data read out by the data read-out portion 115 as an attention pixel, and compares a data of the attention pixel with surrounding data Xi (i=1 to 4 and 6 to 9), and, according to this comparison, adds +1 to the sum when X5 is less than Xi and adds −1 to the sum when X5 is greater than Xi, and thus the total value sum is calculated (steps S708 to S713).

Further, a normalization compensation portion 117 conducts an appropriate normalization process shown in the above formula for the total value sum calculated at the data comparison total value calculation portion 116, then adds the normalized total value sum to the attention pixel X5, then conducts an appropriate gain compensation, and thus outputs data expanded to q bits (steps S714 and S715).

As described above, according to the first embodiment, by appropriately conducting a weight application to an attention pixel according to a flatness of surrounding pixels with saving a local feature of an input picture, p bit (e.g., 8 bit) data of the input picture can be expanded precisely to q bit (e.g., 10 bit or 12 bit) data according to a brightness distribution state of the input picture. As a result, error accumulation due to intermediate rounding operation can be suppressed, and thus display quality deterioration such as false contour or the like can be prevented.

Further, by conducting the bit expansion method of the present invention for an 8-bit input picture, displaying with high grey level can be realized for a high precision display that can realize 10 bits or 12 bits. Further, since the bit expansion method of the present invention can be performed based on a simple comparison operation, there is an advantage that high precision can be realized lightly and at low cost in view of either software or hardware.

Further, in the first embodiment, as surrounding pixels to obtain a logical feature of an input picture, explained is a case that one of the patterns A to C is selected, as shown in FIG. 3, but a set of surrounding pixels is not limited to this. For example, it is possible that a set of surrounding pixels, which are farther from an attention pixel than 8 pixels of the pattern A adjacent to the attention pixel, is set as a set of surrounding pixels father than the pattern B and the pattern C.

According to a brightness distribution state, a set of pixels, which consist of elements of both the pattern B and the pattern C, may be defined as farther surrounding pixels. Alternatively, a set of pixels, which are located at any distance away by 1-pixel interval or more from an attention pixel, may be defined as farther surrounding pixels.

Further, near surrounding pixels are not needed to be limited to 8 pixels adjacent to an attention pixel of the pattern A. For example, according to a brightness distribution state of an input picture, a set of pixels, which consist of elements of both the pattern A and the pattern B, or elements of the pattern B, may be defined as near surrounding pixels.

As a result, it is possible that a region within a certain distance from an attention pixel is defined as near surrounding pixels, and a set of pixels farther from the attention pixel than the near surrounding pixels is defined as farther surrounding pixels. Further, according to irregularity of a set of pixels consisting of near surrounding pixels and an attention pixel, selection of surrounding pixels switches between near pixels and farther pixels.

It will be apparent to those skilled in the art that various modifications and variations can be made in a display device of the present invention without departing from the sprit or scope of the disclosure. Thus, it is intended that the present invention covers the modifications and variations of this disclosure provided they come within the scope of the appended claims and their equivalents.

What is claimed is:

1. A picture signal process apparatus, comprising:

a bit expansion process portion that expands p bits, which is a resolution of a brightness value of a digital input picture, to q bits (where q>p), wherein when a brightness value of an attention pixel of the digital input picture is bit-expanded, the bit expansion process portion applies a weight to the brightness value of the attention pixel according to magnitude relations between brightness values of each of a plurality of surrounding pixels surrounding the attention pixel and the brightness value of the attention pixel, and conducts a gain compensation for the brightness value of the attention pixel based on the applied weight.

2. The apparatus of claim 1, wherein the bit expansion process portion calculates a variation value of brightness values of a 3*3 pixel region with the attention pixel as a center, and sets 8 pixels adjacent to the attention pixels as the surrounding pixels when the calculated variation value is greater than a pre-set decision threshold value, and sets a set of pixels, which are farther from the attention pixel than the 8 pixels adjacent to the attention pixel, as the surrounding pixels when the calculated variation value is equal to or less than a pre-set decision threshold value.

3. The apparatus of claim 1, wherein the bit expansion process portion conducts a normalization for the weight application such that a bit-expanded data after conducting the gain compensation does not exceed ranges to be expressed with the q bits, and after the normalization, conducts the gain compensation the brightness value of the attention pixel after the weight is applied.

4. The apparatus of claim 2, wherein the bit expansion process portion conducts a normalization for the weight application such that a bit-expanded data after conducting the gain compensation does not exceed ranges to be expressed with the q bits, and after the normalization, conducts the gain compensation the brightness value of the attention pixel after the weight is applied.

5. A bit expansion method for a display device having a picture signal process circuit, the method comprising:

expanding p bits to q bits by the picture signal process circuit, wherein q>p, and wherein the p bits are components of a resolution of a brightness value of a digital input picture, the expanding p bits to q bits further comprising:

a weight application step by a bit expansion process portion of the picture signal process circuit, wherein when a brightness value of an attention pixel of the digital input picture is bit-expanded, a weight is applied to the brightness value of the attention pixel according to a magnitude relations between brightness values of each of a plurality of surrounding pixels surrounding the attention pixel and the brightness value of the attention pixel, and a gain compensation for the brightness value of the attention pixel is applied based on the applied weight.

* * * * *